US006892637B2

(12) United States Patent
Petersen

(10) Patent No.: US 6,892,637 B2
(45) Date of Patent: May 17, 2005

(54) SELF-INKING STAMP WITH INK CARTRIDGE BARRIER

(76) Inventor: Craig J. Petersen, 410 Meacham, Park Ridge, IL (US) 60068

( * ) Notice: Subject to any disclaimer, the term of this patent is extended or adjusted under 35 U.S.C. 154(b) by 0 days.

(21) Appl. No.: 10/376,152

(22) Filed: Feb. 28, 2003

(65) Prior Publication Data

US 2004/0168590 A1 Sep. 2, 2004

(51) Int. Cl.[7] ..... B41K 1/38; B41K 1/42; B41K 1/50; B41K 1/54

(52) U.S. Cl. ..... 101/333; 101/327; 101/367; 101/125

(58) Field of Search ..... 101/327–367, 101/125; B41K 1/38, 1/42, 1/50, 1/54

(56) References Cited

U.S. PATENT DOCUMENTS 3,948,173 A * 4/1976 Barasch ..... 101/333
4,624,482 A * 11/1986 Cassells ..... 283/62
5,271,322 A * 12/1993 Palma ..... 101/333
5,285,725 A * 2/1994 Imamaki et al. ..... 101/127.1
5,303,647 A * 4/1994 Seo et al. ..... 101/125
5,577,444 A 11/1996 Toyama
5,899,142 A * 5/1999 Suda et al. ..... 101/125
5,942,312 A 8/1999 Venkataraman et al.
5,996,493 A 12/1999 Okumura et al.
6,164,202 A 12/2000 Takami

* cited by examiner

*Primary Examiner*—Andrew H. Hirshfeld
*Assistant Examiner*—Andrea H. Evans
(74) *Attorney, Agent, or Firm*—Knechtel, Demeur & Samlan

(57) ABSTRACT

A stamp pad holder for use in a self-inking hand stamp. The stamp pad holder has a stamp die box that holds a stamp forming material, ink cartridge and plastic within the die box. The stamp forming material is placed at the bottom of the die box. A pre-inked ink cartridge is placed above the stamp forming material but separated by an impermeable film. The film prohibits ink from flowing from the ink cartridge to the stamp forming material until the film is pulled from the die box prior to use. This permits the ink from the ink cartridge to impregnate the stamp forming material. The die box is then inserted into the hand stamp. A method of manufacturing the die box is also disclosed.

21 Claims, 6 Drawing Sheets

SELF-INKING STAMP WITH INK CARTRIDGE BARRIER

BACKGROUND AND SUMMARY OF THE INVENTION

This invention relates to hand stamps and more particularly to a self-inking hand stamp that has a stamp holder with a pre-inked cartridge mounted in the stamp that inks the image forming stamp material. This invention also relates to the design and manufacture of the die box that holds the stamp forming material and pre-inked cartridge.

Most conventional stamps require manufacturing a stamping member from rubber or other flexible material. The stamping member is mounted on a handle that is grasped by the user. The stamping member is placed into contact with ink, usually contained in an inkpad. The inked stamping member is then pressed against the surface onto which the stamp image is to be transferred. Repetition of the stamping process required that the stamping member be pressed against the inkpad each time an image is to be transferred. This is a disadvantage to the user as it requires extra time for each re-inking step and slows down the stamping process if many stampings are to be done. It also requires the use of a separate inkpad that must be periodically re-inked.

An improved stamp was developed that uses a stamping member made from a permeable material that allows ink to pass through the stamping member. The ink is held within the stamp and allowed to gradually ooze onto the stamping member. This eliminated the need for a separate stamp inkpad. These stamps are referred to as self-inking stamps.

An example of this stamp is illustrated in U.S. Pat. No. 5,577,444 issued to Toyama. This patent illustrates a hand stamp that has a sealed ink compartment that stores the ink. The ink can be refilled into the compartment by means of removing a threaded screw at the top of the compartment. Once the screw is removed, the ink can be injected, and the screw replaced. The stamping member has a stamping surface with stamping and non-stamping portions.

There are several problems with this device. First it requires adding ink through the top to fill or refill the ink chamber. This is a messy procedure. It also may result in adding too little or too much ink to the ink chamber. Second, the chamber must be sealed to allow the ink to only ooze out through the bottom opening onto the stamp pad. Third, the stamp must be kept in its holder when not in use to protect the stamp surface as there is no guard that automatically drops down when the stamp is not pressed onto a stamp receiving surface to keep the stamping surface above the image receiving surface.

Another problem with this stamp is that it continually feeds ink to the entire stamp surface. The recessed portions that are not designed to contact the printing surface still have ink applied to them. This ink evaporates or dries and is wasted ink. The only ink that is needed for printing is the ink applied to the printing portions where the raised letters are located.

Another type of stamp pad is illustrated in U.S. Pat. No. 5,942,312 issued to Venkataraman et al. This patent discloses a pre-inked thermoplastic foam which has open cells in the area that is designed to transfer ink and closed or sealed cells in the area which is designed to be impermeable to ink. The inkpad is pre-inked before the image is formed on the thermoplastic material. Thus if there is a problem with the image, the entire pad including the ink, is wasted.

Furthermore there may be difficulties in forming an image on a pre-inked pad as it may be messy or require special handling due to the ink in the pad.

U.S. Pat. No. 5,996,493 issued to Okumura et al. illustrates a hand stamp that uses an ink pack to supply ink to the porous stamp. The ink pack ruptures when the ink pack is pressed against a cutting device in the stamp. There is a transparent film thermally attached to the stamp surface to protect the stamp surface during transport and storage. The transparent film is removed just before using the stamp for printing images.

Another stamp is disclosed in U.S. Pat. No. 6,164,202 issued to Takami. This patent discloses a stamp unit comprising a holder, which is placed in a stamp manufacturing device for making a stamping surface on a stamp material. The holder interacts with the stamp manufacturing device to properly position the holder in the manufacturing device. The stamp forming material has a positive image or manuscript placed against the stamp forming material. The stamp forming material is irradiated with a xenon light. The part of the material irradiated with the light fuses due to the heating effect of the light. The part of the material not irradiated due to the characters on the manuscript is not fused and remains porous. This forms the image to be printed. The stamp forming material is saturated with ink and ink is allowed to flow out from the non fused portions onto a printing sheet forming the image. This patent describes the method and apparatus to form the stamp image on the stamp forming material and the disclosure is incorporated herein by reference.

The prior art devices do not adequately address the problem of conveniently inking the stamp forming material in a self inking hand stamp. For example U.S. Pat. No. 5,996,493 uses an ink pack that is placed in the stamp and is pierced by a cutting device to disburse the ink. Other self inking hand stamps use an ink cartridge stored in a sealed plastic bag. When the stamp material is ready to be inked, the sealed plastic bag is cut and the ink cartridge is carefully inserted into the stamp, generally in contact with the stamp forming material. To minimize the likelihood of ink getting on the user, a grasping tool such as a tweezers may be used to insert the ink cartridge into the stamp. This is not a convenient method of inking the stamp forming material in self-inking hand stamps. Another problem not solved by the prior art devices is providing an ink cartridge and stamp in a self contained easy to use unit. Also, the method of manufacturing such as unit was never taught.

Applicant's invention addresses and solves the problems of the prior art devices. The invention comprises a container or stamp die box designed for insertion into a hand stamp. The hand stamp has a handle, which is grasped by the user. A stamping member is made of a stamp forming material that is a porous foam material and has a surface made of a porous resin layer. This is the image forming side of the stamping member. A pre-inked ink cartridge is placed adjacent to the side of the stamp forming material opposite the image forming side, but separated by an impermeable plastic film. The stamp forming material, ink cartridge and plastic film are retained in the die box and placed in a stamp forming machine to form the desired image on the image forming side of the stamp forming material. The porous resin layer is melted and solidifies into impermeable areas that are not intended to allow the passage of ink, and the porous resin layer remains unmelted and open in areas that are intended to allow ink to pass. In this manner the stamping image is defined. The ink cartridge is held against the plastic film, which in turn is in intimate contact with the backside of the stamp forming member. The die box is inserted into the hand stamp. When the stamp is ready to be used, the ink impermeable plastic film is pulled out from the die box. This allows the ink from the ink cartridge to flow into the stamp forming material. Once the stamp forming material is adequately saturated, the stamp is ready for use.

The die box is manufactured by placing the stamp forming material in the die box, covering it with the plastic film, placing a frame member around the perimeter of the inside of the die box, inserting an ink cartridge into the frame member, placing ink onto the cartridge, inserting a spacer into the die box, and closing the die box.

OBJECTS AND ADVANTAGES

It is an object to provide a hand stamp that uses an inventive die box containing a pre-inked inkpad to transfer ink to the stamp forming material. A related object is to provide a self-inking hand stamp with a die box that contains a pre-inked inkpad and stamp forming material that easily slides into the self-inking hand stamp. It is another object to provide a die box with a pre-inked inkpad that is separated from the stamp forming material by means of a non permeable plastic member that inhibits the flow of ink from the ink cartridge to the stamp forming material.

Still another object is to provide a die box with a pre-inked ink cartridge that has a plastic member that can be easily pulled out from between the ink cartridge and the stamp forming material to allow the ink to flow from the cartridge to the stamp forming material when the stamp is to be used.

Yet another object is to provide an ink cartridge that is contained within a non permeable bag that has one removable side in contact with the stamp forming material, and when the removable side of the bag is pulled out from the stamp, the ink is allowed to flow into the stamp forming material. A related object is to provide a new method of manufacturing the die box with all of the components contained therein.

The advantage of this invention is that it minimizes the messy operation of inking the stamping member found in the prior art devices by providing a self-contained die box and ink cartridge.

These and other objects and advantages will be apparent from reviewing the following Description of the Drawings and Description of the Preferred Embodiment.

DESCRIPTION OF THE PREFERRED EMBODIMENT

Figure 1:
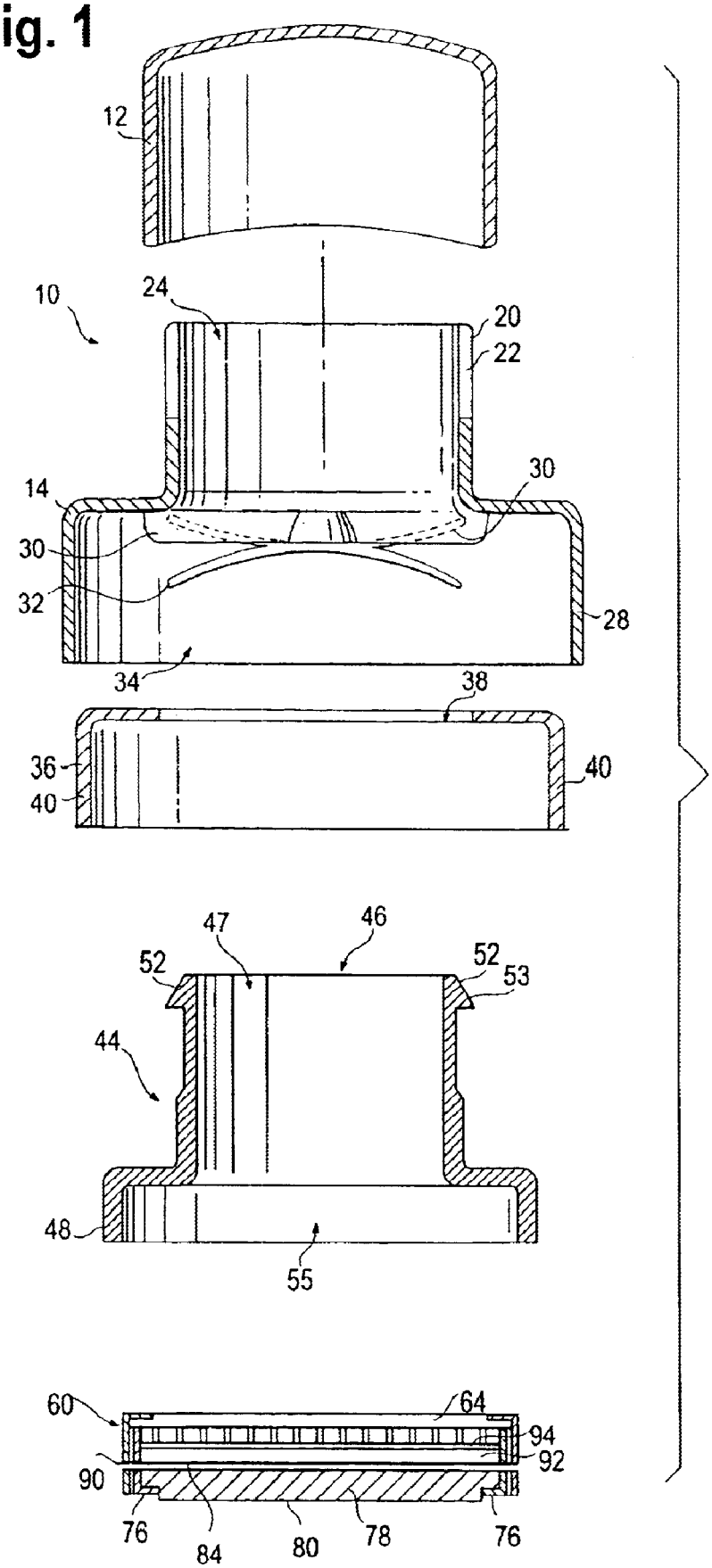
FIG. 1 is an exploded front elevation view of a first embodiment of a self-inking hand stamp in cross section illustrating the orientation of the various parts of the stamp and the inventive die box with ink pad and stamp forming material.

Turning to FIG. 1 there is illustrated one embodiment of a hand stamp 10, which utilizes the present invention. The stamp 10 is commonly referred to as a self inking hand stamp as it does not require the use of a separate inkpad that is not a part of the hand stamp 10. There is a handle cover 12 designed to be grasped by the user. The handle cover 12 is mounted over a stamp frame 14.

The stamp frame 14 has a handle 20 at an upper portion 22 with a central passageway 24. The handle cover 12 is adapted to be slipped over the handle 20 to cover the central passageway 24. The handle has a lower portion 28 that has a pair of retainer plates 30 along each of its longest sidewalls. The retainer plates 30 hold two arms of a double wishbone spring member 32. The other two arms of the wishbone spring member extend downward toward a bottom opening 34 of the stamp frame 14.

A moveable shield 36 is dimensioned to be received within the bottom opening 34 of the lower portion 28 of the stamp frame 14. The moveable shield 36 has a shield opening 38 that is aligned with the central passageway 24 in the stamp frame 14. The moveable shield 36 has upstanding walls 40 that have a height sufficient to protrude below the bottom opening 34 when the shield is assembled into the lower portion 28. The shield 36 contacts the lower ends of the spring member 32. In its normal non printing position, the moveable shield 36 is in contact with the surface that is to be imprinted with an image. If a downward force is applied to the handle 20, the moveable shield 36 moves upward.

A stamp mount 44 is received into the stamp frame 14. The stamp mount 44 has an upper end 46 with an opening 47 and a lower end 48 with an open bottom 55. At the top of the stamp mount 44 are a pair of flexible latches 52 with barbs or catches 53. These retain the stamp mount into the frame 14.

Figure 2:
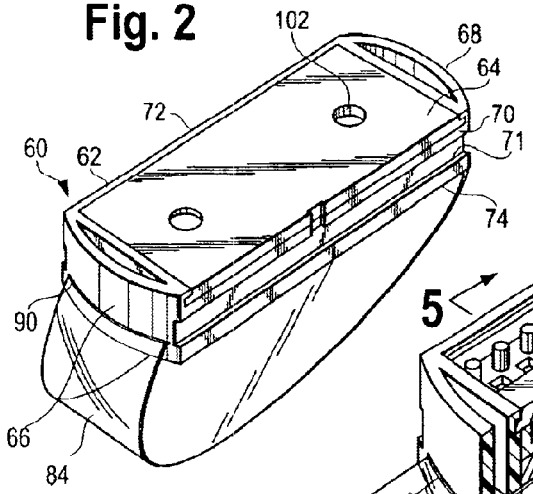
FIG. 2 is a perspective view of the stamp die box with the impermeable film extending out from the die box.
Figure 3:
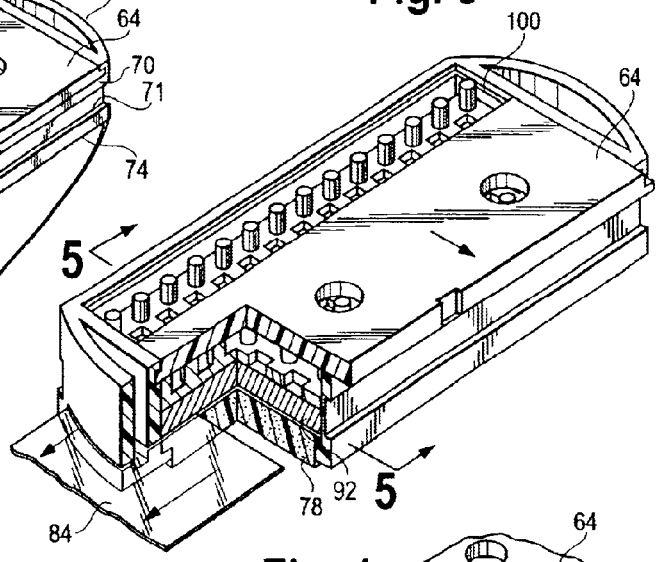
FIG. 3 is a perspective view partially in cross section of the die box, which contains the ink cartridge, and stamp forming material.
Figure 4:
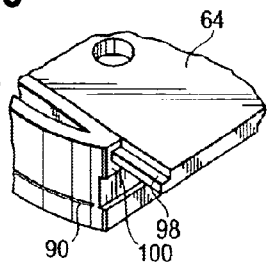
FIG. 4 is a perspective view with portions removed of one corner of the die box showing the cover of the die box being received by the die box frame.

The open bottom 55 is adapted to receive the inventive stamp die box or frame 60. The die box is somewhat rectangular is shape with elliptical ends, but the actual shape is defined by the shape of the stamp and the stamping image desired. As seen in FIG. 2, there is a top 62 with a removable cover 64. There are sides extending about the entire die box. As illustrated there are a paid of opposite sides 66 and 68, a front side 70 and a rear side 72. A channel 71 is cut along the front side 70 and rear side 72 extending from the opposite sides 66 to 68. There is an open bottom 74, which is defined by a ledge 76 (FIG. 5) extending around the perimeter of the die box 60.

Inside of the die box 60 is a porous foam stamping member 78 that has a printing side or stamp surface 80 and an opposite non-printing side 82. The stamp forming member is made from a porous soft resin in which optical energy absorbing material is dispersed. To produce an image onto the stamping member 78, a transparent film having the positive image to be created is placed against the stamp surface 80. The image is normally comprised of black and clear areas. With the transparent film with the image thereon against the stamp surface 80, the stamping member 78 is placed in a sealed light box with the stamp surface 80 pressed against a clear glass or plastic member. A xenon light is placed in the light box below the stamp surface 80 and energized for a predetermined time. The rays from the xenon light irradiate the stamp surface 80 through the transparent film wherever there were clear image areas. This causes a chemical reaction fusing the foam from the heat. This seals what were the clear areas resulting in areas that are non-permeable to the ink passing through the stamp surface 80. The rays do not penetrate the black image areas on the film and thus no reaction occurs on the stamp surface 80. These areas remain unsealed and thus ink permeable. Machinery for this stamp forming process is available in the industry. Other methods to form the image on the foam stamping member 78 are available which provide ink permeable and ink impermeable areas to define the image.

A plastic impermeable film 84 is placed on top of the stamp forming material 78. The film 84 is in contact with the non printing side 82 of the foam stamping member 78. The film 84 completely covers the non printing side 82 of the stamp forming member 78. To accomplish this, the side edges of the plastic film 84 can be received in grooves or channels 85 cut along the length of the inside of front side 70 and inside of rear side 72. (See FIG. 5). The film has opposite ends 86 and 88. The end 86 is releasably retained within the die box 60 when the die box is assembled. The other end 88 extends out through a film channel opening 90 in the side 66. The loose end 88 can be brought back over the stamp surface 80 to cover and protect the surface 80 as seen in FIG. 2. It is then attached by releasable adhesive to the side 68. If the loose end 88 is to be pulled back over the stamp surface 90, the loose end 88 beginning from the opening 90 must be clear so that the image can be burned onto the stamp surface 80 when placed in the stamp manufacturing machine. The part of the film 84 over the stamp forming material 78 can be clear or colored.

A pre-inked ink cartridge or inkpad 92 is placed above the film 84. The ink cartridge 92 is preferably made of a porous foam material that absorbs and retains a thick printing ink. The ink cartridge 92 is soaked in ink and placed in the stamp die box 60 above the film 84 during manufacture and assembly of the stamp die box 60. The film 84, being impermeable to the ink, prohibits the flow of ink from the ink cartridge 92 to the to stamp forming material 78. The die box 60 with the ink cartridge is stored in a sealed plastic bag to keep the ink cartridge from drying out. In an alternate embodiment, the ink cartridge 92 is placed in a plastic or other impermeable bag, and the entire enclosed bag is placed in the die box. The bottom of the bag has its bottom scored along score lines running along the bottom length of the bag. A loose end attached to or part of the bottom of the bag extends out from the opening 90. In this embodiment only the ink cartridge is sealed.

Above the ink cartridge 92 is a pressure plate 94 that has a plurality of upstanding, flexible pins 96 on its surface. The bottom of the pressure plate has numerous holes or openings 97 between the pins 96. When the die box is assembled, the pressure plate 94 acts as a spacer and also exerts a compressive force on the ink cartridge 92, keeping it in intimate contact with the film 84, which in turn is pressed against the stamp forming material 78.

The removable cover 64 has a tongue 98 along each side. There is a groove 100 cut into the interior of the sides 66 and 68 of the die box 60. The tongue 98 is received into the groove 100 to allow the cover 64 to slide over the top 62 of the die box 60. This encloses the die box 60 and causes a compressive force to be applied against the pressure plate 94.

Figure 5:
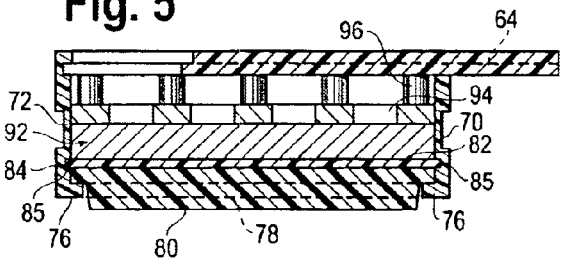
FIG. 5 is a cross sectional view taken along line 5—5 of FIG. 3.
Figure 6:
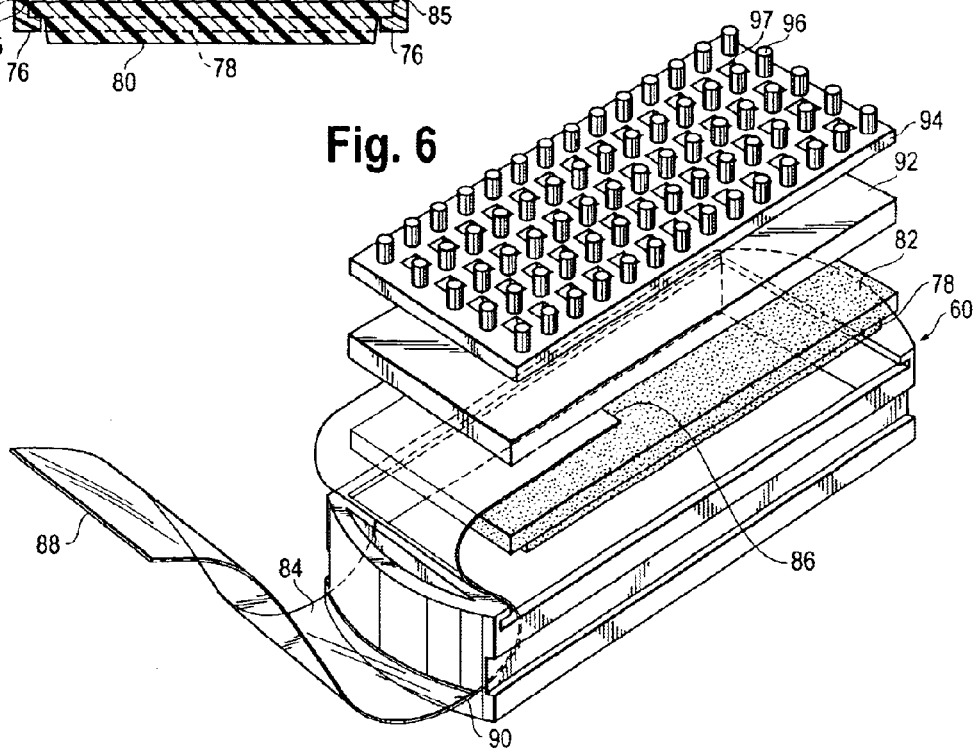
FIG. 6 is an exploded perspective view of the die box illustrating its internal components including the pressure plate, ink cartridge, impermeable film, and stamp forming material.

As seen in FIG. 5, the stamp forming material 78 is placed with the stamp surface 80 in the die box 60 so that the ledge 76 supports the edges of the stamp forming material. The stamp forming material 78 is dimensioned to be received snugly within the ledge 76 with the stamp surface and image extending slightly below the ledge 76. This allows the stamp forming material to be retained within the stamp die box 60 yet allow the stamp surface 80 to extend below the bottom of the die box 60 for printing.

Once the die box is placed in the stamp manufacturing machine, and the image is burned onto the stamp surface 80 as conventionally done, the die box is ready for use in a hand stamp. The die box is removed as a unit from the stamp manufacturing machine. The user grasps the loose end 88 of the film 84 and pulls the film 84 out from the die box 60. The film exits the die box 60 through the film channel 90. As the end 86 of the film is not secured to the die box 60, the user must only overcome the friction between the film 84 and the ink cartridge 92 and the non printing side 82 of the stamp forming material 78 in order to pull the film 84 from the die box 60. Once the film 84 is pulled out from the die box 60, ink from the ink cartridge 92 can flow into the stamp forming material 78. This normally takes at least one hour for the stamp forming material 78 to be sufficiently saturated so that an image can be made at the stamp surface 80 for printing onto a receiving medium. Prior to saturation, the user inserts the die box into the hand stamp 10. There is sufficient time for the user to insert the die box 60 into the hand stamp 10 without getting dirty with ink as the ink has not yet saturated the forming material 78 to the stamp surface 80.

In the alternate embodiment where the ink cartridge is stored in its own plastic bag, the loose end of the bag extending out from the opening 90 is pulled by the user. This tears open the bottom of the bag allowing the ink to escape and ink the stamp forming material. The other parts of the hand stamp and die box and sequence of operation is the same as the first preferred embodiment.

The die box 60 can be inserted into the stamp 10 from the open bottom 56 and is retained by frictional engagement with the wall of the stamp mount 44. Other means such as clips, catches or snaps can be used to keep the die box 60 within the stamp mount 44.

Figure 7:
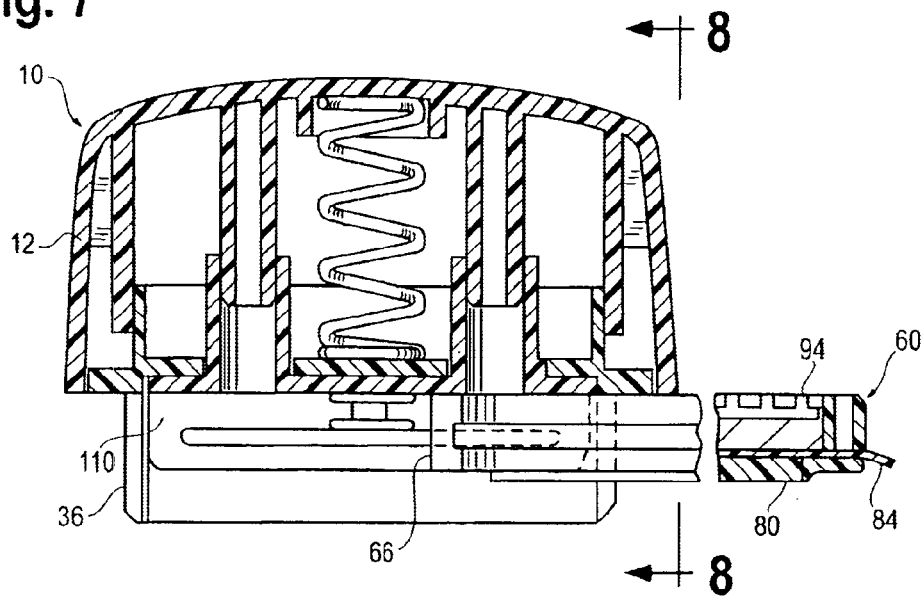
FIG. 7 is a front elevation view of an alternative self-inking hand stamp partially in cross section that utilizes the inventive die box.
Figure 8:
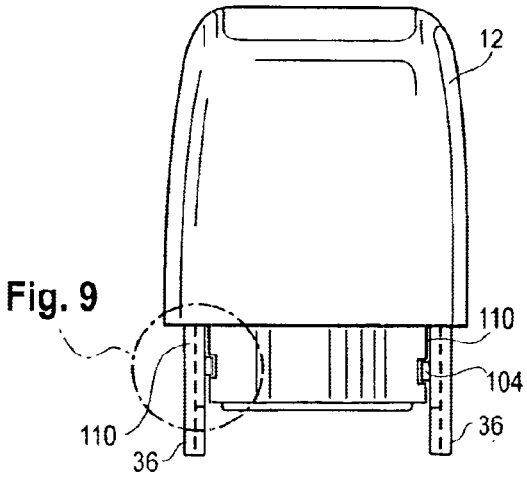
FIG. 8 is an end view of the alternative self-inking hand stamp of FIG. 7.
Figure 9:
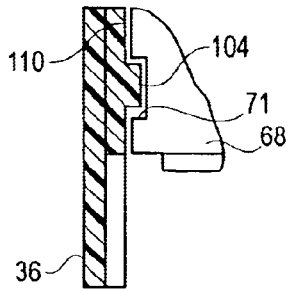
FIG. 9 is an enlarged view of the circled area of FIG. 8.

In the alternate embodiment as illustrated in FIGS. 7–9, the handle 12 supports a fixed frame 110. The moveable shield 36 surrounds the fixed frame 110. The die box 60 is slid horizontally between opposite walls of the fixed frame. A second tongue 104 extends along the inside of the opposite walls of the fixed frame 110. The second tongue is received in the channel 71 as the die box slides into the stamp 10. The die box 60 is inserted into the stamp 10 until the edge 66 engages the end of the fixed frame 110. The die box 60 is then completely inserted into the stamp 10. The stamp is used just as in the previous embodiment. The user withdraws the plastic film 84 and the ink from the ink cartridge impregnates the foam material. To use the stamp 10, the user pushes down on the handle 12, which forces the moveable, shield 36 into the handle 12. The stamp surface 80 contacts the image receiving surface and the image on the stamp surface 80 is transferred to the image receiving surface.

When no ink remains in the cartridge or when the cartridge dries out, the ink cartridge 92 can be re-inked. This can be done by several methods. In the first embodiment, the handle cover 12 is removed, and ink can be injected through the central passageway 24 and into the holes 102 in the cover 64. The ink passes through the numerous openings 97 in the bottom of the pressure plate 94, into the ink cartridge 92. Alternatively, and in the second embodiment, the die box 64 is removed from the stamp 10, the cover 64 is removed and a new ink cartridge 92 is inserted or the old cartridge is re-inked.

Figure 10:
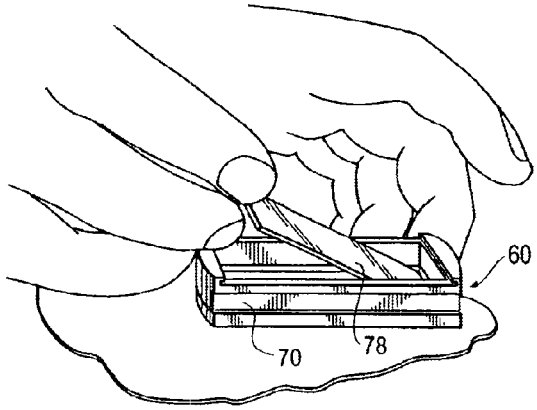
FIGS. 10–19 are successive drawings illustrating the assembly of the inventive die box and its individual components and inking the ink cartridge before the final assembly and closing of the die box.
Figure 11:
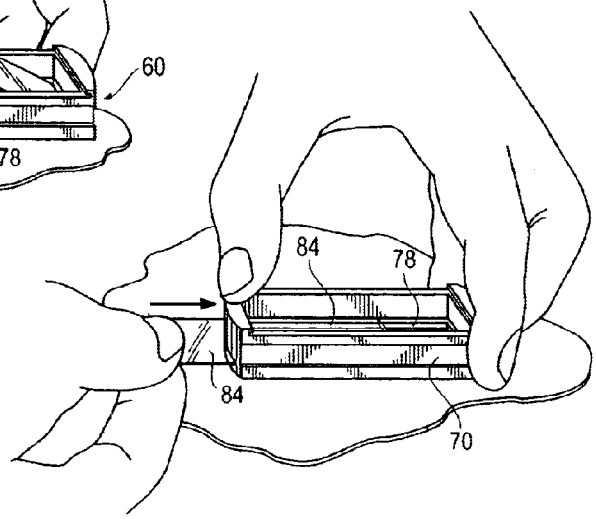

FIGS. 10–19 illustrate an alternate die box 60 and method of manufacturing it. As seen in FIG. 10, the user places the stamp forming material 78 through the top 62 into the die box 60. The ledge 76 supports the edges of the stamp forming material 78. Next, the plastic film 84 is slid into the die box 60 through the film channel 90. In this embodiment, the channels 85 are not present to receive the plastic film 84. Instead the width of the plastic film 84 is very close to the width of the stamp forming material 78 and extends across substantially the entire surface of the stamp forming material 78. The plastic film 84 is inserted into the die box 60 until the end of the film 84 strikes the end 68. In this position, the non printing side 82 of the stamp forming material 78 is completely covered.

Figure 12:
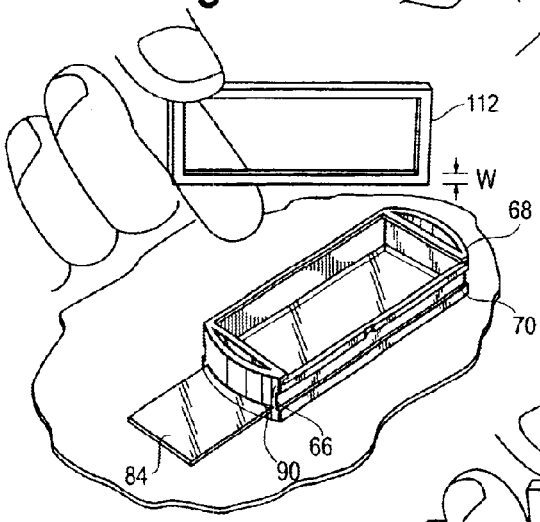
Figure 13:
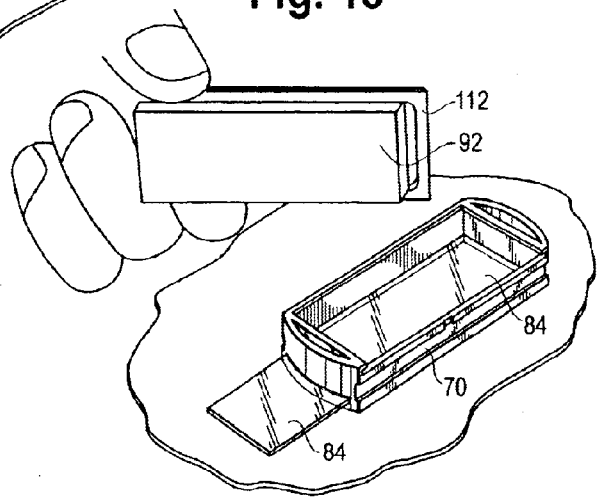
Figure 14:
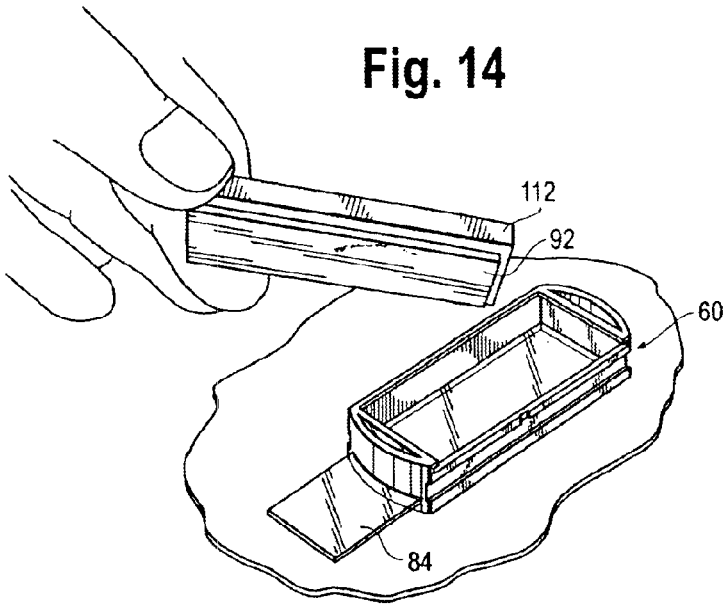
Figure 15:
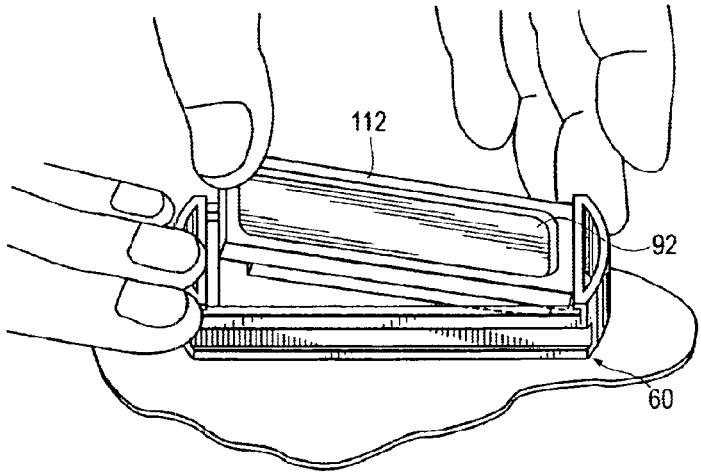
Figure 16:
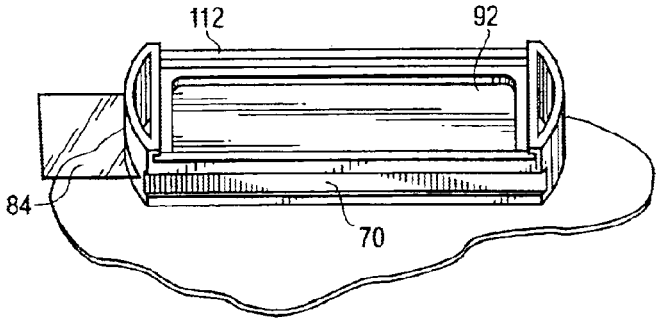

Next a framing member 112 is securely held and a non-inked ink cartridge 92 is centered on and inserted into the framing member 112. This is illustrated in FIGS. 12 and 13. The framing member is dimensioned to fit snugly inside of the opposite walls 66, 68 and front and rear sides 70, 72. A width "w" of the framing member is approximately 1/16 inch. This forms approximately a 1/16 inch border around the entire perimeter of the stamp forming material 78. The framing member 112 with the ink cartridge 92 is inserted into the die box 60 on top of the plastic film 84 as seen in FIGS. 14–16.

Figure 17:
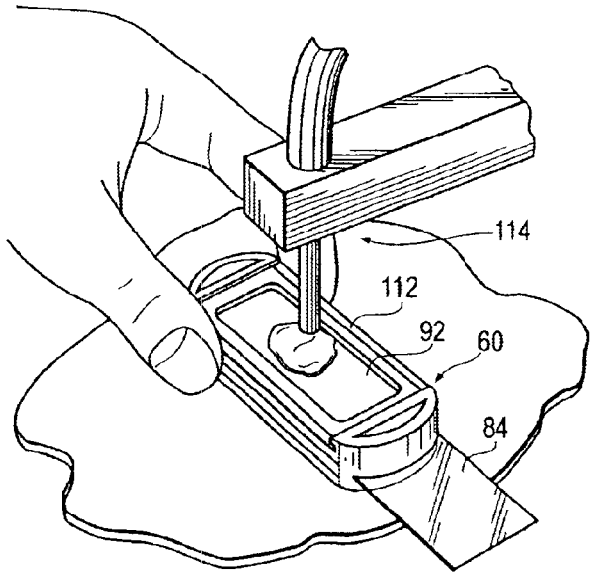

The ink cartridge 92 is then saturated with a predetermined amount of ink as seen in FIG. 17. An ink filling station 114 dispenses a pre-measured amount of ink onto the cartridge 92. The ink spreads across the cartridge 92 and soaks into the cartridge 92.

Figure 18:
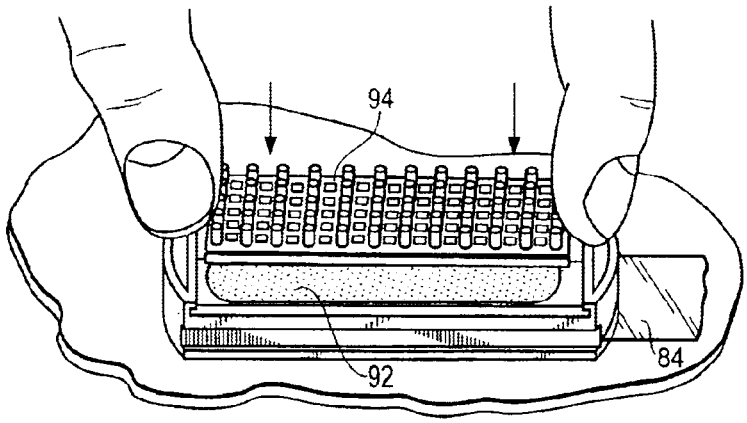
Figure 19:
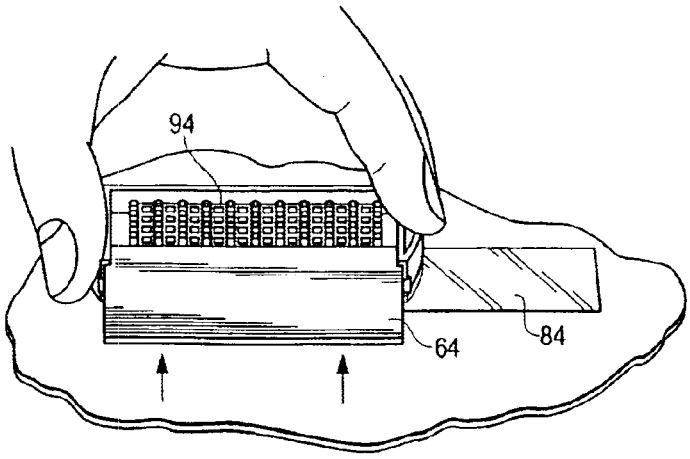

The plate 94 is then placed over the ink cartridge 92 as illustrated in FIG. 18. In FIG. 19 the removable cover 64 is slid over the top 62 to close the die box 60 and keep all the components within the die box 60.

In the first die box embodiment, the plastic film 84 is received in the grooves 85 and completely covers the stamp forming material 78 so that the ink from the cartridge 92 cannot migrate into the stamp forming material 78. In the second die box embodiment, the framing member 112 keeps the sides of the ink cartridge 92 from touching the insides of the front, rear and opposite sides, 66, 68, 70 and 72. If the inked cartridge touches the sides, ink from the cartridge will migrate along the insides of the sides, eventually migrating into the stamp forming material 78. This is undesirable, as the image has not yet been burned onto the image forming stamp surface 80. The framing member forms a spacer to keep the cartridge out of contact with the sides of the die box 60.

Applicant's invention provides a die box and method of manufacturing the same which has the stamp forming material separated from the pre-inked cartridge by the plastic film. The user does not have to go through the messy process of placing the inked cartridge into the die box before use. All that the user has to do to ink the stamp forming material is to remove the plastic film. The entire die box can be packaged in an airtight plastic bag or other enclosed container so that the ink cartridge does not dry out before the stamp is used.

Thus there has been provided a stamp pad holder for use in a self-inking hand stamp that fully satisfies the objects and advantages set forth herein. While the invention has been described in conjunction with a specific embodiment, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. A stamp pad holder for use in a self-inking hand stamp comprising:

a stamp die box having a top, a bottom and opposite sides, mechanical interlocking means on the sides for being slidably received by the self-inking hand stamp for securely and releasably retaining the stamp die box to the self-inking hand stamp, a stamp forming material mounted at the bottom of the die box, the stamp forming material having an ink receiving side, an image forming side and perimeter edges, the perimeter edges of the stamp forming material being totally contained within the die box, a pre-inked cartridge mounted in the stamp die box adjacent to the ink receiving side of the stamp forming material, a removable cover at the top of the die box, a pressure plate disposed between the cover and the pre-inked cartridge for applying a force to the pre-inked cartridge for pushing the pre-inked cartridge against the stamp forming material, the cover securing the stamp forming material, pressure plate and pre-inked cartridge inside of the die box, and a non permeable film disposed between the pre-inked cartridge and the ink receiving side of the stamp forming material for prohibiting the flow of ink from the pre-inked cartridge to the stamp forming material until the film is removed from between the pre-inked cartridge and the stamp forming material at which time the ink can flow from the pre-inked cartridge to the stamp forming material thereby impregnating the stamp forming material with ink.

2. The stamp pad holder of claim 1 and further comprising exit means on the die box for allowing the non permeable film to be pulled out from the die box.

3. The stamp pad holder of claim 2 wherein the exit means comprises a channel in at least one side of the die box.

4. The stamp pad holder of claim 2 wherein the non permeable film has two opposed ends, one end releasably mounted within the stamp die box and the other end protruding out from the exit means.

5. The stamp holder of claim 4 wherein the other end protruding out from the exit means forms a grasping portion for a user to grasp to pull the non permeable film from the die box.

6. The stamp holder of claim 1 and further comprising a second non permeable film placed over the image forming side of the stamp forming material until it is removed prior to use of the hand stamp.

7. The stamp holder of claim 5 wherein the grasping portion extends out from the exit means and forms a cover to cover the image forming side of the stamp forming material until it is removed prior to use of the hand stamp.

8. The stamp pad holder of claim 1 wherein the cover is slidably removable from the top of the die box.

9. The stamp pad holder of claim 1 and further comprising at least one opening in the cover for allowing ink to be introduced into the die box to re-ink the cartridge.

10. The stamp pad holder of claim 1 and further comprising a spacer member disposed between the pre-inked cartridge and the cover for receiving ink between the cover and pre-inked cartridge to re-ink the pre-inked cartridge.

11. A stamp pad holder for use in a self-inking hand stamp comprising:

a stamp die box having a top, a bottom, sides and a removable cover at the top of the die box, mechanical interlocking means on the sides for being slidably received by the self-inking hand stamp for releasably and securely retaining the stamp die box to the self-inking hand stamp, a stamp forming material mounted at the bottom of the die box, the stamp forming material having an ink receiving side, an image forming side and perimeter edges, the perimeter edges of the stamp forming material being totally contained within the die box, a framing member mounted inside the die box adjacent to the sides, the framing member having a thickness;

a pre-inked cartridge mounted in the framing member and separated from the sides by the thickness of the framing member, the pre-inked cartridge adjacent to the ink receiving side of the stamp forming material, a pressure plate disposed between the cover and the pre-inked cartridge for applying a force to the pre-inked cartridge for pushing the pre-inked cartridge against the stamp forming material, the cover securing the stamp forming material, pressure plate, pre-inked cartridge and framing member inside of the die box, and a non permeable film disposed between the pre-inked cartridge and the ink receiving side of the stamp forming material for prohibiting the flow of ink from the pre-inked cartridge to the stamp forming material until the film is removed from between the pre-inked cartridge and the stamp forming material at which time the ink can flow from the pre-inked cartridge to the stamp forming material thereby impregnating the stamp forming material with ink.

12. The stamp pad holder of claim 11 and further comprising exit means on the die box for allowing the non permeable film to be pulled out from the die box.

13. The stamp pad holder of claim 12 wherein the non permeable film has two opposed ends, one end releasably mounted within the stamp die box and the other end protruding out from the exit means.

14. The stamp pad holder of claim 11 wherein the cover is slidably removable from the top of the die box.

15. The stamp pad holder of claim 11 and further comprising at least one opening in the cover for allowing ink to be introduced into the die box to re-ink the cartridge.

16. The stamp pad holder of claim 11 and further comprising a spacer member disposed between the pre-inked cartridge and the cover for receiving ink between the cover and pre-inked cartridge to re-ink the pre-inked cartridge.

17. A method of impregnating a stamp forming material with ink for use in a hand stamp comprising the steps of:

providing a die box with an open bottom, inserting and securing a stamp forming material at the open bottom of the die box, placing an impermeable film on top of the stamp forming material, placing an ink cartridge that is impregnated with ink on top of the impermeable film, placing a pressure applying member on top of the ink cartridge, enclosing the die box with a removable cover so that the ink cartridge, film, pressure applying member and stamp forming material are contained within the stamp die box, with the pressure applying member and cover separated by an ink receiving space and withdrawing the film allowing the ink from the ink cartridge to flow into the stamp forming material thereby impregnating the stamp forming material with ink.

18. The method of claim 17 and the further step of inserting the die box into a hand stamp and mechanically interlocking the die box with the hand stamp.

19. A method of making a stamp die box for use in a self-inking hand stamp comprising:

providing a die box frame with an open top and open bottom and continuous sides, inserting a stamp forming material at the open bottom of the die box frame, placing an impermeable film on top of the stamp forming material, placing an ink cartridge into a framing member, the framing member surrounding the perimeter of the ink cartridge, placing the ink cartridge and framing member into the die box frame on top of the impermeable film, the framing member keeping the ink cartridge out of contact with the sides of the die box frame, placing a pressure applying member on top of the ink cartridge, covering the open top of the die box frame with a removable cover having an ink receiving hole therein so that the ink cartridge, framing member, film, pressure applying member and stamp forming material are contained within the stamp die box frame with the pressure applying member and cover separated by an ink receiving space.

20. The method of claim 19 and the further step of dispensing ink into the ink receiving hole in the cover thereby impregnating the ink cartridge with ink.

21. The method of claim 20 and the further step of placing the assembled stamp die box into an airtight enclosed container until it is to be used.

* * * * *